US006647680B2

(12) United States Patent
Daly et al.

(10) Patent No.: US 6,647,680 B2
(45) Date of Patent: Nov. 18, 2003

(54) BOTTOM RAIL

(75) Inventors: Aaron Daly, Waldachtal (DE); Guenther Seibold, Pfalzgrafenweiler (DE)

(73) Assignee: Proline Profil System GmbH, Boppard (DE)

( * ) Notice: Subject to any disclaimer, the term of this patent is extended or adjusted under 35 U.S.C. 154(b) by 0 days.

(21) Appl. No.: 10/045,868

(22) Filed: Jan. 10, 2002

(65) Prior Publication Data

US 2002/0095895 A1 Jul. 25, 2002

(30) Foreign Application Priority Data

Jan. 11, 2001 (DE) ..... 201 00 413

(51) Int. Cl.[7] ..... E04C 2/00; E04F 15/14

(52) U.S. Cl. ..... 52/287.1; 52/396.04; 52/396.05; 52/461; 52/463

(58) Field of Search ..... 52/287.1, 396.04, 52/396.05, 395, 461, 463, 464, 466, 468

(56) References Cited

U.S. PATENT DOCUMENTS

| | | | | | |
|---|---|---|---|---|---|
| 3,543,326 | A | * | 12/1970 | Rohrberg et al. | 16/16 |
| 4,156,300 | A | * | 5/1979 | Jarfavail et al. | 16/5 |
| 4,893,449 | A | * | 1/1990 | Kemper | 52/464 |
| 5,155,952 | A | * | 10/1992 | Herwegh et al. | 52/100 |
| 5,657,598 | A | | 8/1997 | Wilbs et al. | |
| 6,345,480 | B1 | * | 2/2002 | Kemper et al. | 52/395 |
| 6,357,192 | B1 | * | 3/2002 | Schluter | 52/459 |
| 2002/0050109 | A1 | * | 5/2002 | Grosjean | 52/393 |

FOREIGN PATENT DOCUMENTS

| | | | |
|---|---|---|---|
| AT | 002 214 | | 6/1998 |
| DE | 4439 963 | | 5/1996 |
| DE | 299 16 138 | | 1/2001 |
| DE | 299 19 138 | | 1/2001 |
| EP | 0 588 734 | | 3/1994 |
| EP | 696667 | A1 * | 2/1996 |
| EP | 0801187 | A1 * | 10/1997 |
| EP | 0 801 187 | | 10/1997 |
| EP | 1231334 | A2 * | 8/2002 |
| FR | 2 367 886 | | 6/1978 |

* cited by examiner

*Primary Examiner*—Kimberly Wood
(74) *Attorney, Agent, or Firm*—Bachman & LaPointe, P.C.

(57) ABSTRACT

The invention relates to a bottom rail strip for bridging a joint between two floor coverings. The invention proposes that the bottom rail be designed with a hinge, by means of which one cover profile strip of the bottom rail can be laterally swivelled. The hinge makes it possible to adjust the bottom rail to floor coverings of varying height, and offset height differences.

6 Claims, 2 Drawing Sheets

BOTTOM RAIL

BACKGROUND OF THE INVENTION

The invention relates to a bottom rail for bridging a joint in a floor with the features a swivel connecting.

Bottom rails are known in the art. They are used to bridge a joint in a floor, e.g., at a transition from a floor covering (e.g., parquet) to another floor covering (e.g., tile), at the transition from one room to another room, or to define the edge of a carpet on a floor. The various floor coverings can exhibit different heights, so that a step must also be bridged on the joint.

A bottom rail is known from DE 37 43 896 C2. The known bottom rail is designed in two parts, with a cover profile strip and a holder for securing it to the floor. The holder of the known bottom rail is also designed as a profile strip, and can be attached in the joint on the floor to be bridged, e.g., with screws or adhesives. The cover profile strip covers edges of the floor coverings adjacent to the joint on either side, sits up on the adjacent floor coverings, and bridges the joint between the floor coverings. The flexible design of the cover profile strip and, if necessary, varying heights of the cover profile strip on both sides of the bottom rail make it possible to cover a step on the joint.

It is the object of the invention is to provide a bottom rail that can be readily adjusted to floor coverings of varying height.

SUMMARY OF THE INVENTION

The foregoing object is achieved according to the invention by providing a swivel connection. The bottom rail according to the invention has a hinge, with which the cover profile strip can be swivelled around a swivelling axis running in the longitudinal direction of the bottom rail. The hinge causes the cover profile strip to automatically swivel into a position during assembly in which it sits up on the floor coverings on either side of a joint, even if the floor coverings vary in height. The flexibility of the cover profile strip further improves the ability to adapt the bottom rail.

The bottom rail according to the invention can exhibit a number of individual holders, which are distributed in the longitudinal direction of the bottom rail and secured in the joint in the floor. The bottom rail preferably has a holder that extends continuously in the longitudinal direction of the bottom rail and is designed as a profile strip.

In one embodiment of the invention, the hinge on the bottom rail has a hinge shaft with cylindrical surfaces on sides facing away from each other. The hinge shaft can deviate from the cylindrical shape on the remaining surface sections. The hinge shaft with its cylindrical surfaces sits in a shaped groove, which based on its cross-sectional shape exhibits a back-cut, into which the hinge shaft is pivoted.

To couple the swivelling capability with a height-adjustment capability for the bottom rail, one embodiment of the invention provides for a tongue-and-groove joint between the cover profile strip and the holder. By incorporating the springs to varying depths in the groove, a height for the cover profile strip over a base of the joint in which the bottom rail holder is secured can be set.

In a further development of the invention, there are interruptions in the tongue of the tongue-and-groove joint, into which screws can be tightened. The tightened screws project laterally over the tongue, so that their threads engage the bearers of the groove. In this way, a joint safeguarded against any lifting of the cover profile strip can be created. Despite this fact, the cover profile strip can still be detached from the holder without any destruction after removing the screws. Since the threads of the tightened screws engages both the bears of the groove and the tongue, the screws fix the tongues into the groove at the selected insertion depth. In this way, the tightened screws fix the cover profile strip on the holder at the set height.

Another embodiment of the invention provides for a latching device, e.g., with a catch that engages the gearing from the back, to connect the cover profile strip with the holder. This design enables a rapid attachment of the cover profile strip to the holder by simply pressing in, without the need for a threaded joint.

In a preferred embodiment of the invention, the bottom rail has a support for the cover profile strip, which supports the cover profile strip in a stable manner when the installed bottom rail is stepped on.

The hinge shaft can be designed as a single piece with the cover profile strip or holder in embodiments of the invention, so that the bottom rail is in two pieces. In this case, the hinge shaft is formed by spherically designing the lateral surface of a web, which is in a single piece with the cover profile strip or the holder. The spherical surfaces of the web lay in the shaped groove of the respective other section of the bottom rail. Another embodiment of the invention has the hinge shaft as a separate part of the bottom rail.

BRIEF DESCRIPTION OF THE DRAWINGS

In the following, the invention will be described in greater detail based on two embodiments shown on the drawing.

DETAILED DESCRIPTION OF THE DRAWINGS

Figure 1:
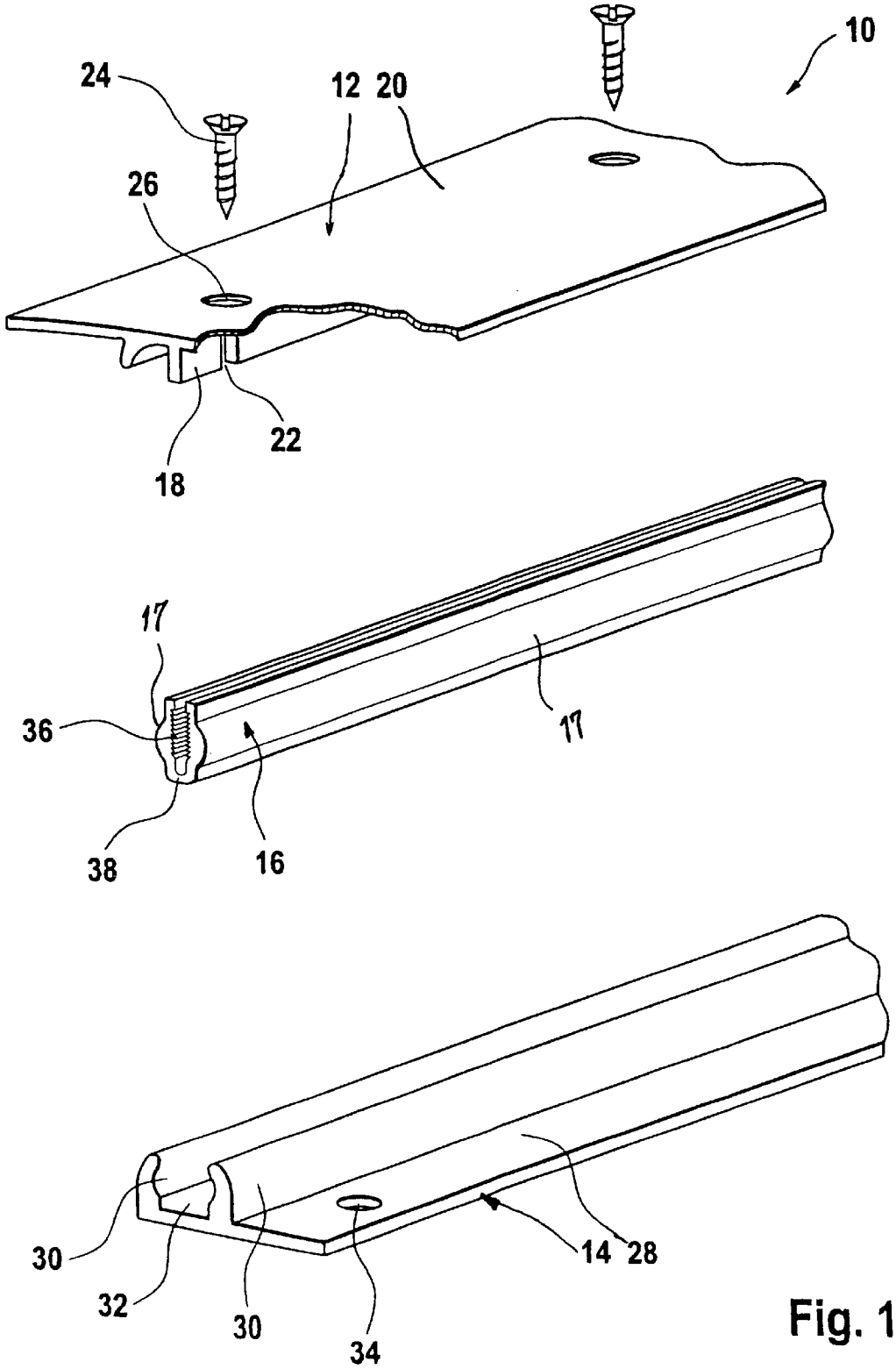
FIG. 1 is an exploded, perspective view of the bottom rail according to the invention.

The bottom rail 10 according to the invention shown on FIG. 1 has a cover profile strip 12, a holder 14 and a hinge shaft 16. The three parts 12, 14, 16 of the bottom rail 10 can consist of plastic or metal. They are preferably flexible.

Figure 2:
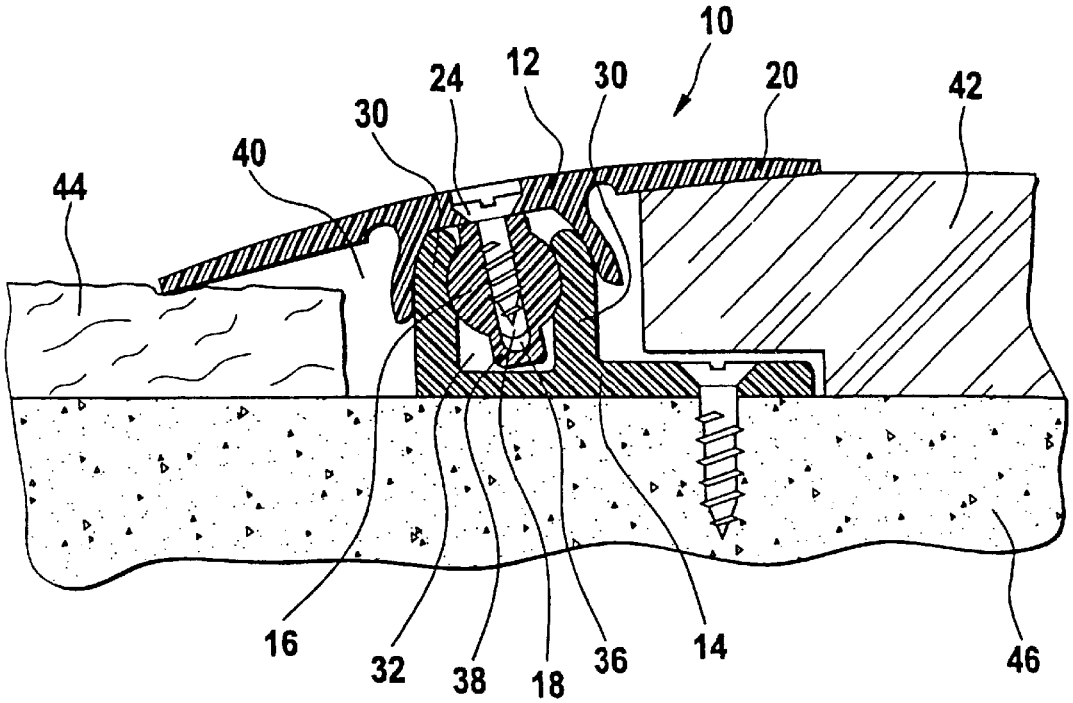
FIG. 2 is the bottom rail from FIG. 1 in an assembled and disassembled state, cross section.

The cover profile strip 12 has a T-shaped cross section, with a web 18 and curved crossbeam 20 (compare FIG. 2). The web 18 is provided with interruptions 22 for tightening screws 24. The interruptions 22 are designed as slits in the web 18. The crosshead 20 exhibits holes 26 flush with the interruptions for inserting the screws 24.

The holder 14 is designed as a profile strip with a base plate 28, from which two curved spring pins 30 project in the longitudinal direction of the holder 14. The spring pins 30 are arranged parallel and at a distance from each other, and envelop an elongated groove 32 with a shaped or substantially U-shaped cross section. The base plate 28 protrudes over one side of the spring pins 30, and is there provided with screw holes 34.

The hinge shaft 16 exhibits cylindrical surfaces 17 on two sides of its periphery facing away from each other (which engage spring pins 30 as described below), and its cross section is shown on FIG. 2. It is provided with a longitudinally running groove 36, whose bearer surfaces exhibit a gearing running in a longitudinal direction. On an open side of the side facing away from the groove 36, the hinge shaft 16 exhibits a longitudinally running fitting strip 38 that forms a single piece with it and has roughly a rectangular cross section.

FIG. 2 shows the layout of the bottom rail 10. The bottom rail 10 according to the invention is installed in a groove 40 between two floor coverings 42, 44, for example. In the embodiment shown, the floor covering is parquet 42 on the right, while the floor covering on the right is a carpet 44, which are laid on a sub-floor 46. To install the bottom rail 10, its holder 14 is first placed in the groove 40, and screwed or adhesively bonded with the sub-floor 46, for example. The hinge shaft 16 is subsequently snapped into the shaped groove 32 between the two spring pins 30 of the holder 14 which engage surfaces 17. Its groove 36 makes the hinge shaft 16 flexibly compressible, so that it can be effectively snapped between the also flexible spring pins 30. The hinge shaft 16 is positively pivoted in the shaped groove 32 with its cylindrical surfaces facing away from each other. The hinge shaft 16 forms a hinge on the bottom rail 10 with the spring pins 30.

The cover profile strip 12 is then placed on, so that its web 18 gets into the groove 36 of the hinge shaft 16, and the cover profile strip 12 sits up on both sides of the bottom rail 10 with its curved crossbeam 20 on the floor coverings 42, 44. Varying heights of the floor coverings 42, 44 on both sides of the bottom rail 10 are offset by swiveling the cover profile strip 12 in the hinge 16, 30 about a swiveling axis. The height is adjusted using the insertion depth of the web 18 of the cover profile strip 12 into the groove 36 of the hinge shaft 16. The web 18 of the cover profile strip 12 and the groove of the hinge shaft 16 form a tongue-in-groove joint 18, 36, so that the web 18 can also be referred to as the tongue 18 of the tongue-in-groove joint 18, 30. Finally, the screws 24 are inserted into the holes 26 in the cover profile strip 12 in the interruptions 22 of the web 18 and tightened. Threads of the screws 24 cut into the surfaces of the web 18 bordering the interruptions 22 in the process. In addition, the screw threads protrude laterally over the web 18, so that they engage the bearer surfaces of the groove 36. In this way, the screws 24 connect the cover profile strip 12 with the hinge shaft 16, and fix the cover profile strip 12 on the hinge shaft 16 in terms of height.

The fitting strip 38 of the hinge shaft 16 stands on a base of the shaped groove 32 of the holder 14, forming a support 38, which supports the cover profile strip 12 in a stable manner, for example when stepped on. The crossbeam 20 of the cover profile strip 12 covers the groove 40 between the two floor coverings 42, 44.

As long as the web 18 of the cover profile strip 12 is not inserted into the groove 36 of the hinge shaft 16, the hinge shaft 16 can be readily and flexibly compressed, and thereby snapped into the shaped groove 32 of the holder 14. If the web 18 of the cover profile strip 12 is inserted into the groove 36 of the hinge shaft 16, the hinge shaft 16 can no longer be compressed, so that it has a good, positive fit in the shaped groove 32 of the holder 14.

Figure 3:
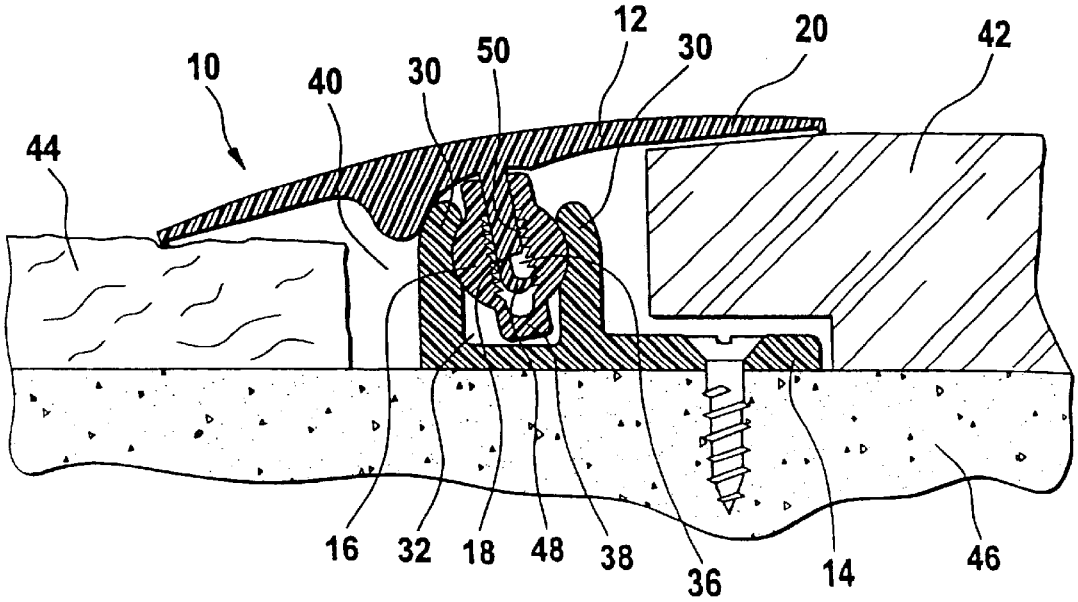
FIG. 3 is a second embodiment of a bottom rail according to the invention in the view shown on FIG. 2.

FIG. 3 shows an embodiment of a bottom rail 10 according to the invention that has been modified relative to FIGS. 1 and 2. To avoid repetition, only the differences between the two embodiments will essentially be covered below, and reference is otherwise made to the above statements regarding FIGS. 1 and 2 with respect to FIG. 3. The same reference numbers as in FIGS. 1 and 2 are used on FIG. 3 for identical components.

The bottom rail 10 from FIG. 3 exhibits a latching connection between the cover profile strip 12 and the hinge shaft 16 in place of a screwed connection. The free longitudinal edge of the web 18 of the cover profile strip 12 exhibits a longitudinally continuous latching element 48 with a hook-shaped cross section, which interacts with a gearing 50 of the bearer surfaces of the groove 36. The gearings 50 are formed on both bearer surfaces of the groove 36, so that the cover profile strip 12 can also be inserted in reverse. The gearings 50 run in a longitudinal direction, and exhibit a serrated profile. Pressing the web 18 of the cover profile strip 12 into the groove 36 of the hinge shaft 16 causes the latching element 48 of the web 18 latch into one of the two bearings 50 of the bearer surfaces the groove 36 of the hinge shaft 16, and prevents the cover file strip 12 from peeling off. The cover profile strip 12 of bottom rail 10 from FIG. 3 is connected with the hinge shaft and holder 14 with screws by pressing it into the groove 36 of hinge shaft 16 with its web 18. Otherwise, the bottom rail shown on FIG. 3 is identical in design to the bottom rail 10 shown on FIGS. 1 and 2.

It is to be understood that the invention is not limited to illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A bottom rail for bridging a joint in a floor comprising a cover profile strip (12) secured to a hinge shaft (16) at a height therefrom, the hinged shaft is received in a shaped groove (32) of a holder (14), wherein the cover profile strip swivels relative to the holder around a swiveling axis, and including means for adjustment of the height of the cover profile strip with respect to the hinge shaft.

2. The bottom rail according to claim 1, wherein the means for adjustment comprises screws (24) having threads, the threads of the screws projecting laterally out of the cover profile strip (12) and engaging the hinge shaft (16).

3. The bottom rail according to claim 2, wherein the means for adjustment further comprises a tongue-and-groove joint (18, 36), the tongue (18) is located on the profile strip and includes interruptions (22) for the screws (24) wherein, the threads of the screws engaging the groove (36) located in the hinge shaft (16).

4. The bottom rail according to claim 1, wherein the means for adjustment comprises a latching device (48, 50) for connecting the cover profile strip (12) with the hinge shaft (16).

5. The bottom rail according to claim 1, wherein the holder (14) is formed as an elongated strip.

6. The bottom rail according to claim 1, further comprising a support (38) for the cover profile strip (12).

* * * * *